US005218373A

United States Patent [19]

Heckaman et al.

[11] Patent Number: 5,218,373

[45] Date of Patent: Jun. 8, 1993

[54] HERMETICALLY SEALED WAFFLE-WALL CONFIGURED ASSEMBLY INCLUDING SIDEWALL AND COVER RADIATING ELEMENTS AND A BASE-SEALED WAVEGUIDE WINDOW

[75] Inventors: Douglas Heckaman, Indialantic; Ronald Vought, Melbourne, both of Fla.

[73] Assignee: Harris Corporation, Melbourne, Fla.

[21] Appl. No.: 590,813

[22] Filed: Oct. 1, 1990

[51] Int. Cl.[5] ..... H01Q 13/02; H01Q 1/42; H01P 3/08

[52] U.S. Cl. ..... 343/786; 333/246; 343/783; 343/784; 343/872

[58] Field of Search ..... 343/700 MS, 872, 873, 343/878, 879, 778, 786, 772, 782–785, 846, 847; 174/51, 52.3, 52.4; 361/392, 394–396, 399, 424; 333/246, 247; 343/778, 786, 772, 782–785, 846, 847

[56] References Cited

U.S. PATENT DOCUMENTS

| | | | |
|---|---|---|---|
| 4,614,947 | 9/1986 | Rammos | 343/786 |
| 4,626,865 | 12/1986 | Rammos | 343/786 |
| 4,819,004 | 4/1989 | Argintaru et al. | 343/786 |
| 4,827,276 | 5/1989 | Fukuzawa et al. | 343/778 |
| 4,829,314 | 5/1989 | Barbier et al. | 343/778 |
| 5,019,829 | 5/1991 | Heckaman et al. | 343/700 MS |
| 5,023,624 | 6/1991 | Heckaman et al. | 343/878 |
| 5,065,123 | 11/1991 | Heckaman et al. | 333/246 |

*Primary Examiner*—Rolf Hille
*Assistant Examiner*—Peter Toby Brown
*Attorney, Agent, or Firm*—Evenson, Wands, Edwards, Lenahan & McKeown

[57] ABSTRACT

Directed millimeter wave radiation from internal elements of a microwave circuit through the housing cover, housing base, and side walls of a hermetically-sealed MMIC integrated subsystem assembly uses a waffle-wall array of conductive posts as a band rejection filter to provide walls which guide the radiated waves through a hermetically sealed window in the housing base for waveguide propagation or to a dielectric side wall or cover to radiate energy therethrough. For a waveguide launch, the launch probe is printed on a TEM mode microstrip transmission line substrate and is located over or on a dielectric window formed at the end of an air filled waveguide. A waveguide-like mode of propagation is launched perpendicular to the microstrip substrate and the energy is transmitted through the dielectric window into the air dielectric waveguide which extends through the housing base. Side wall mounted antennas use radiating elements placed near the side walls of the subsystem assembly and are surrounded on their remaining sides by the conductive post structure. The launched waves propagate toward the dielectric side wall to radiate outwardly from the subsystem assembly. For radiating energy through the subsystem assembly cover, a launch probe is located under a dielectric aperture in the hermetically-sealed cover.

35 Claims, 12 Drawing Sheets

HERMETICALLY SEALED WAFFLE-WALL CONFIGURED ASSEMBLY INCLUDING SIDEWALL AND COVER RADIATING ELEMENTS AND A BASE-SEALED WAVEGUIDE WINDOW

BACKGROUND AND SUMMARY OF THE INVENTION

The present invention relates generally to microwave transmissions and, more particularly, to providing microwave radiation and/or waveguide transmissions from a hermetically-sealed monolithic microwave integrated circuit (MMIC) subsystem assembly.

It has proven difficult to allow directed millimeter wave signal radiation from internal elements formed on the circuit side of a microstrip substrate through its top cover, bottom base or side walls of a hermetically-sealed MMIC subsystem assembly. This is because the subsystem assembly requires a hermetic seal, radio frequency grounding and radio frequency shielding to properly launch the millimeter wave signals.

Providing a waveguide launch from the bottom base of the hermetically-sealed subsystem assembly has previously been performed using a microstrip launch requiring a "dog house" type of cover formed over the radiating element or launch probe plus a narrow microstrip channel formed in the microstrip substrate to prevent waveguide mode leakage. The dog house cover is used to provide the required waveguide backshort termination and mode filter.

Other methods for transmitting the radiated energy have included the use of hermetic coaxial ports. For use in the millimeter waveband, however, hermetic coaxial ports must be very small and hence, the coaxial glass seals, which themselves are difficult to assemble and bond, must be soldered to the housing wall between the MMIC chips and a conventional coaxial-to-waveguide launch probe. This is a time consuming, labor intensive and costly process.

There is therefore needed a structure which allows radiating elements to be placed on the chip side of the microstrip substrate to radiate millimeter waves outward from the subsystem assembly while allowing maximum heat conduction from the chip to the housing base. The radiating elements or launch probes should be capable of radiating signals through the hermetically-sealed housing cover and side walls as well as through the housing base to a hermetically-sealed waveguide port coupled thereto.

The present invention provides a number of structures allowing directed millimeter wave radiation from internal elements of a microwave circuit through the housing cover, housing base, and side walls of a hermetically-sealed MMIC integrated subsystem assembly. A "waffle-wall" configured array of conductive posts are provided between the assembly's housing cover and microstrip substrate to prevent X-Y direction waveguide propagation parallel to the microstrip substrate by providing an electrical connection from the microstrip substate's ground plane up to a metallic top shield of the cover. This two-dimensional periodic post structure functions as a band rejection filter to provide the "walls" which guide the radiated waves through a hermetically sealed window in the housing base for waveguide propagation or to a dielectric side wall or cover to radiate energy therethrough. The periodic array of conductive posts are configured in the waffle-wall pattern as described in copending application Ser. No. 591,034, now U.S. Pat. No. 5,065,123 filed on an even date herewith and assigned to the Assignee of the present invention, the specification of which is herein incorporated by reference.

The present invention provides a waveguide launch from a typical E field launching probe to a hermetically-sealed waveguide port coupled through the housing base of the integrated subsystem assembly. The launch probe is printed on a TEM mode microstrip transmission line substrate and is located over or on a glass or ceramic dielectric window formed at the end of an air filled waveguide, e.g. a circular or rectangular waveguide. A waveguide-like mode of propagation is launched perpendicular to the microstrip substrate and the energy is transmitted through the dielectric window into the air dielectric waveguide which extends through the housing base.

The present invention further allows radiating elements to be placed near the side walls of the subsystem assembly for use as sidewall-mounted antennas. The sidewall-mounted antenna has a typical vertical E field radiating element or launch probe located near the ceramic dielectric side wall and surrounded on its remaining three sides by the conductive posts of the waffle-wall configuration. The vertical E field launch probe is bonded to the end of a microstrip transmission line on the microstrip substrate. The launch probe launches a vertically polarized TE-type waveguide mode between the microstrip substrate's ground plane and the parallel conducting surface of the housing cover. The launched wave propagates toward the dielectric side wall to radiate outwardly from the subsystem assembly. The waffle-wall configuration of conducting posts prevents any wave propagation over the microstrip substrate by functioning as a band rejection filter in all directions (except toward the side wall) parallel to the ground plane.

Similarly, for radiating energy through the subsystem assembly cover, a launch probe is located under a dielectric aperture in the hermetically-sealed cover. A waveguide-like mode of propagation is launched perpendicular to the microstrip substrate and exits through the dielectric aperture located directly above. Again, the waffle-wall conductive post structure provides the necessary waveguide mode ground current connection from the ground plane up to the cover's conducting surface.

It is an advantage of the present invention to provide a waveguide launch from a housing base having lower attenuation and higher phase repeatability than the previously mentioned glass-sealed coaxial launches.

The edge o side wall radiating elements provide the capability of designing miniature millimeter wave MMIC integrated receiver/transmitter subsystem assemblies having the capability to switch or compare sector beams over a 360° azimuth. When combined with the cover radiating elements, full hemisphere coverage is obtained. The present invention can be used for direction finding, radar warning receivers, directional communications, aircraft-carrier-to-aircraft initialization data links, satellite-to-satellite communications links, tank-to-tank communications, etc.

It is a further advantage of the present invention to provide radiating elements and waveguide launches which are of lower cost, size, and weight than current designs. Further, the waffle-wall configuration provides flexibility for many miniature millimeter wave communications applications.

Other objects, advantages and novel features of the present invention will become apparent from the following detailed description of the invention when considered in conjunction with the accompanying drawings.

DETAILED DESCRIPTION OF THE DRAWINGS

Sealed Waveguide Window

The periodic array of conductive posts arranged in the waffle-wall type of configuration between the substrate and the housing cover isolate or "reject" waveguide transmissions parallel to the substrate while allowing waveguide mode transmissions perpendicular to the microstrip substrate, as described in the co-pending application Ser. No. 591,034, now U.S. Pat. No. 5,065,123, incorporated by reference above. As a result of this waffle-wall post structure, millimeter waves can be launched directly from a microstrip launch probe into a waveguide attached perpendicularly to the substrate. The waveguide, such as a rectangular or circular waveguide, is attached to a hermetically sealed waveguide window formed in the plane of the substrate.

Figure 1:
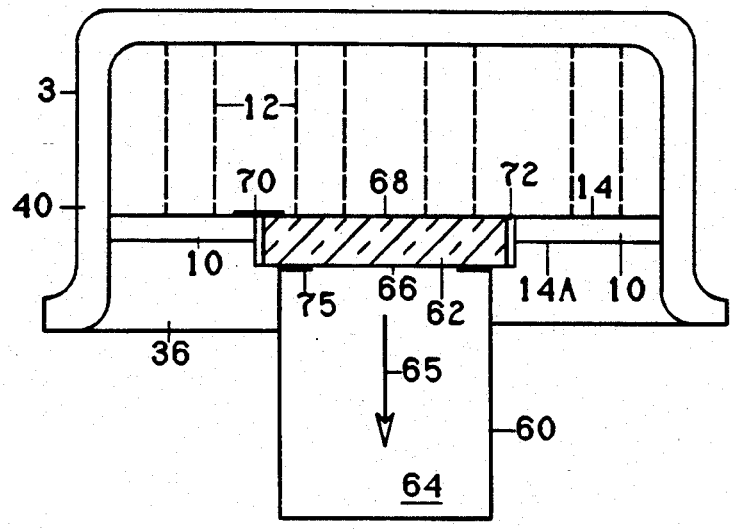
FIG. 1 is a side view illustrating an embodiment of a hermetically-sealed waveguide window located in the housing base of a MMIC subsystem assembly.

Referring to FIG. 1, an embodiment of a hermetically sealed waveguide window located in the housing base of a millimeter wave monolithic microwave integrated subsystem assembly is shown. An air dielectric waveguide 64, which propagates wave transmission signals in the direction indicated by arrow 65, has side walls 60 which can be configured to form the appropriately dimensioned waveguide, for example, a cylindrical $TE_{11}$ or rectangular $TE_{01}$ waveguide. The side walls 60 may be formed, for example, from a Kovar or CuW material. A ceramic or glass launch substrate 62, which forms a dielectric waveguide window, is soldered to one end of the waveguide side walls 60 and forms a hermetic seal between the launch substrate 62 and the waveguide 64. The launch substrate 62 has patterned metalization on its top surface 68 and bottom surface 66 for forming the launch probe and for hermetically sealing with the waveguide 64.

Figure 2:
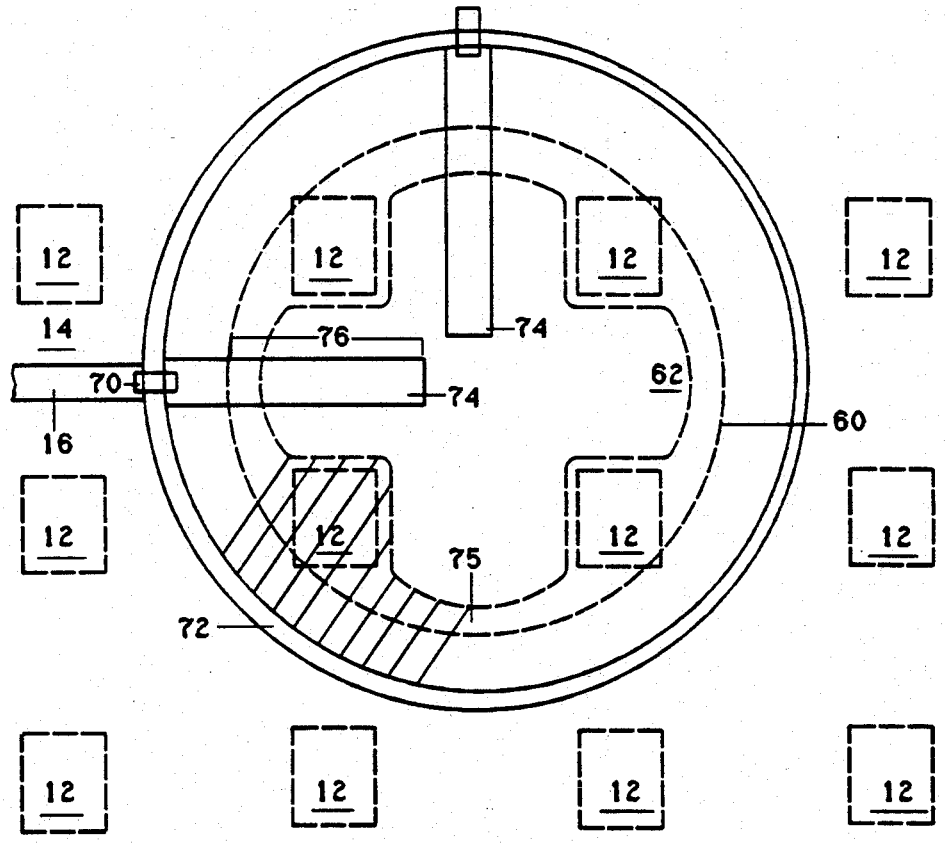
FIG. 2 is a top view of an embodiment of FIG. 1 having a separate launch probe.

The launch substrate 62 is located between sections of microstrip substrate 10. The microstrip substrate 10 is formed atop the housing base 36 and has a housing cover 40. A periodic array matrix of conductive posts 12 are located between the substrate top surface 14 and the housing cover 40 in the waffle-wall configuration to provide isolation between circuit components formed on the microstrip substrate 10. In addition to bounding the energy fields radiating horizontally to the microstrip substrate 10 and launch substrate 62, the conductive posts 12 provide a low impedance ground current connection from the microstrip ground plane 14A and 75 to the housing cover 40. The housing cover 40, functioning as a conducting cover plane, provides the necessary backshort circuit for a broad bandwidth E field type of waveguide radiating element or launch probe. The launch probe 74 can be located on the launch substrate 62 as shown in FIG. 2. Two of such E field type launch probes 74, are printed on the launch substrate 62 and are coupled via ribbon bonds 70 across an air gap circumference 72 formed around the dielectric window 62 to a microstrip transmission line 16 formed on the top surface 14 of the microstrip substrate 10.

As shown in the top view of FIG. 2, the waveguide side walls 60 are represented by dashed lines and the launch substrate 62 has its are of backside metalization 75 indicated by the dashed lines. Also indicated by dashed lines 12 are the locations of the contacting or non-contacting conductive posts which prevent waveguide mode propagation parallel to the launch substrate 62 and therefore into or out of the radiation launch probe area. As noted above, the connections from the MMIC chips to the launch probes 74 are via the TEM mode microstrip lines 16 which are run through the conductive post array 12. The bounding of the wave propagation fields by the conductive posts 12 located around the launch probe 74 within the enclosure 3, ensure that the waves are efficiently launched from the launch substrate 62 into the open end of the waveguide 64 as indicated by arrow 65. Further, the periodically arrayed conductive posts 12 can be series tuned via the launch substrates dielectric material gap capacitance, which provides shielding and provides the low impedance electrical connection from the microstrip ground plane to the housing cover metalization.

As shown in FIG. 2, two launch probes 74 are arranged transversely to each other to provide a dual mode launch. In one example, the portions 76 of the launch probes 74, which are within the interior of the waveguide side walls 60, are dimensioned to have approximately a quarter wavelength in the operating frequency band when the backshort formed via the conductive posts 12 is positioned approximately a quarter wavelength away. The conductive posts 12 can also be set to any necessary length for proper operation.

Figure 3:
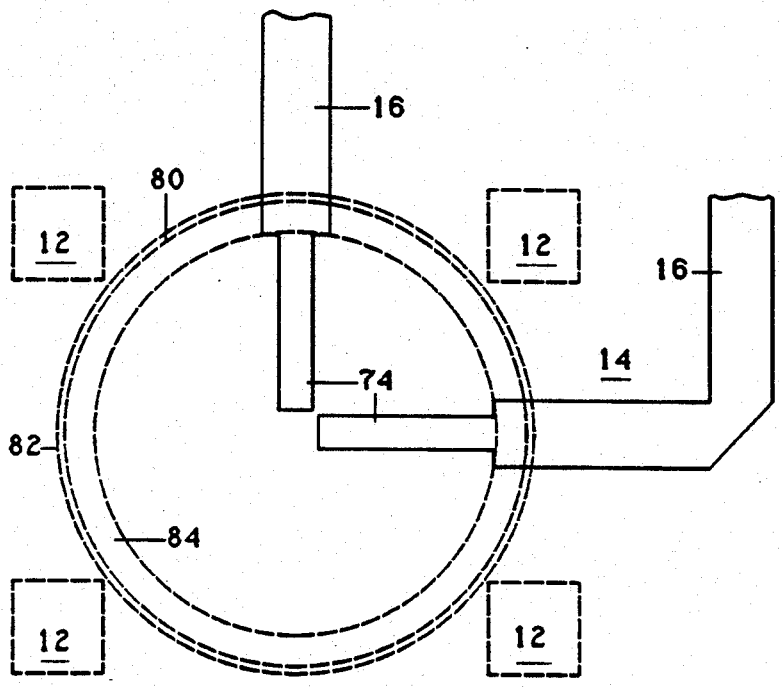
FIG. 3 is a top view of another embodiment of FIG. 1 having a continuous launch probe.

Referring to FIG. 3, there is shown a top view of a hermetically sealed waveguide window wherein the microstrip substrate 10 continuously extends over the circular waveguide. In this arrangement, no ribbon bonds 70 are required to couple the microstrip transmission lines 16 with the launch probes 74. The use of the continuous microstrip substrate having top surface 14 is possible for a hermetic substrate such as ceramic. However, where the substrate is an organic material such as Teflon, it is necessary to provide a lower hermetic seal with the waveguide, one type of which is shown in FIG. 4.

Figure 4:
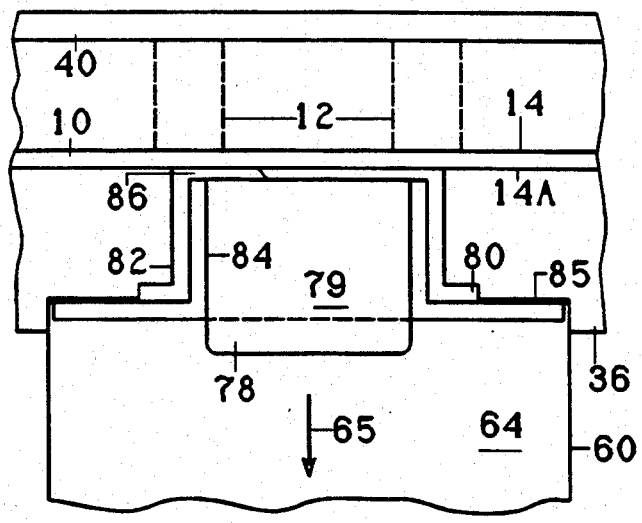
FIG. 4 is a cross-sectional side view of another embodiment according to the present invention.

The lower hermetic seal, as shown in FIG. 4, is provided by a half wavelength quartz waveguide section 79 which has a transformer end 78 to impedance match between the half wavelength section 79 and the full diameter air dielectric waveguide 64. The quartz waveguide section 79 has a very low thermal coefficient of expansion (TCE), and it therefore may be necessary to absorb the differential TCE between the quartz section 79 and the housing base 36. The absorption of the differential TCE is accomplished by a choke joint type of window assembly indicated generally at 82. The choke joint is formed with a thin walled eyelet 84, e.g. a Kovar eyelet, which is compression sealed to the half wavelength quartz waveguide 79 a its inner circumference and is soldered to the aluminum housing base or body 36 via solder seals 85. The aluminum housing body 36 provides a sufficient spacing 80 to absorb the differential TCE. The choke joint 82 reflects a short circuit up to the microstrip ground plane gap 86. This allows current to flow from the waveguide wall 60 into the microstrip ground plane and then into the conductive post tuning capacitors 12 to complete the waveguide transmission circuit.

Figure 5:
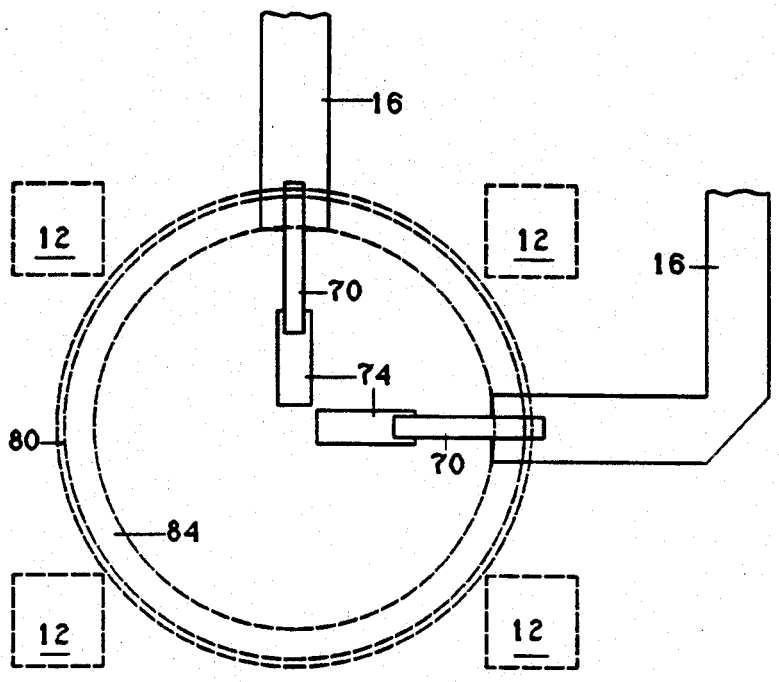
FIG. 5 is a top view of an embodiment described in FIG. 4
Figure 6:
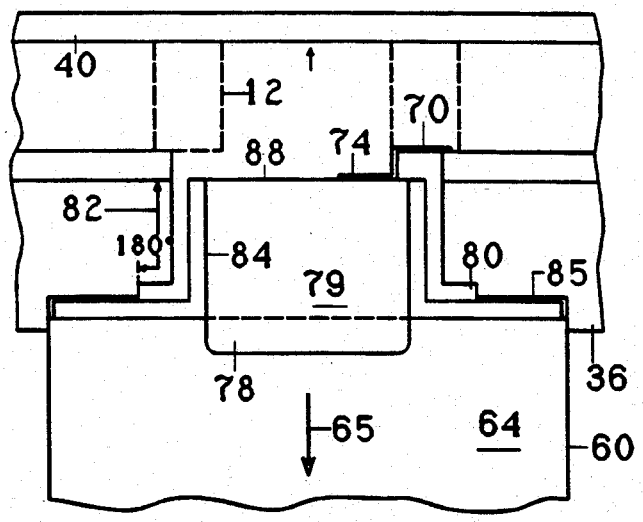
FIG. 6 is a cross-sectional side view of another embodiment according to the present invention.

Referring to FIGS. 5 and 6, there is shown a top view and cross-sectional view, respectively, of a launch structure similar to that of FIG. 4 but having the E field type launch probes 74 printed directly on one end 88 of the quartz waveguide 79. In this embodiment, the microstrip transmission lines 16 couple with the launch probes 74 via ribbon bonds 70.

Figure 7:
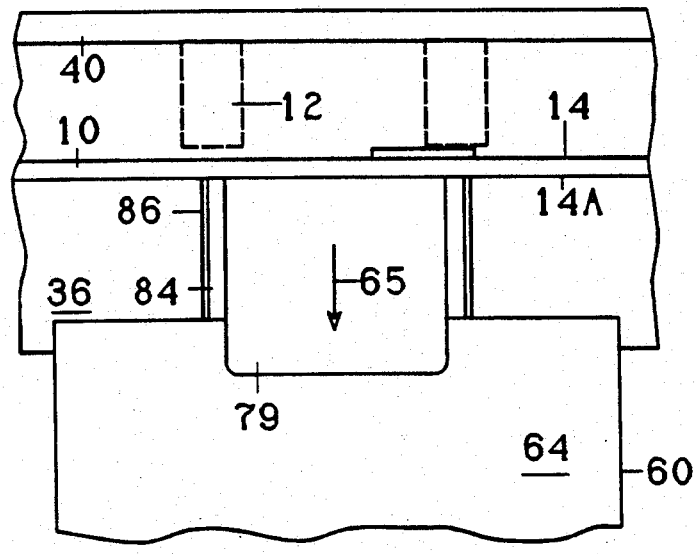
FIG. 7 is a cross-sectional side view of another embodiment according to the present invention.
Figure 8:
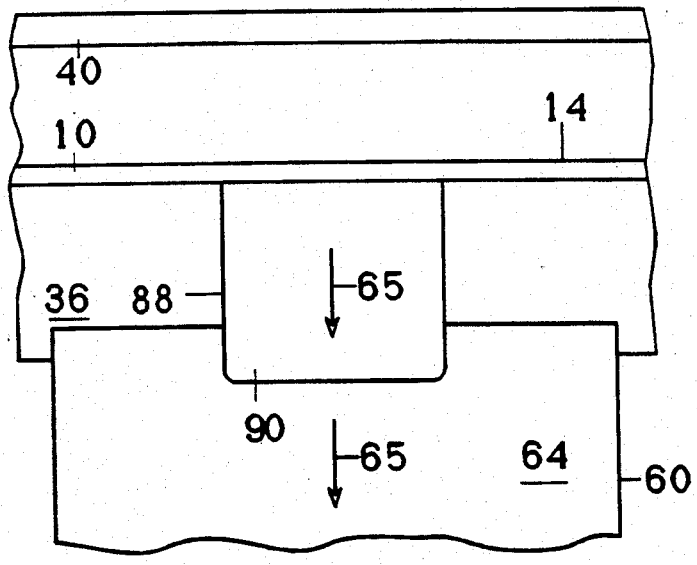
FIG. 8 is a cross-sectional side view of another embodiment according to the present invention.

FIG. 7 shows an alternate embodiment which can be used if the housing base body 36 is composed of a material having a TCE close to that of the hermetic window 79. For example, if the housing body 36 is formed of a Kovar or CuW material, then a quartz waveguide 79 having compression sealed thereto a Kovar ring 84, can be soldered as indicated at 86 directly to the housing body 36. In this example, the small differential TCE between the body 36 and the hermetically sealed window 79 is absorbed in the soft solder joint 86. Alternately, as shown in FIG. 8, a ceramic mode waveguide 90 having a metalized outer surface 88 could be soldered directly into the housing body 36.

Edge Radiating Elements

Figure 9:
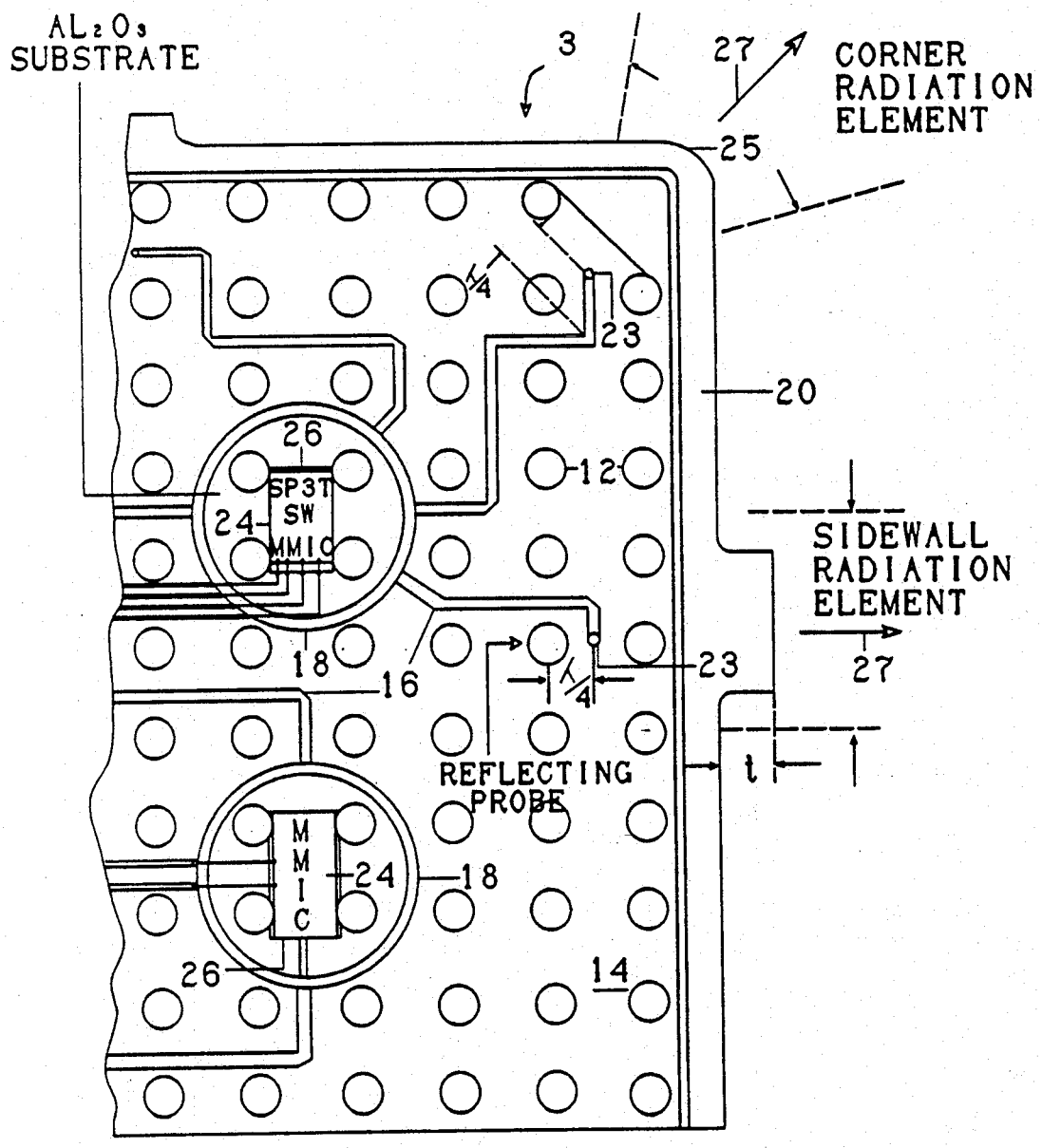
FIG. 9 is a top view of a portion of an integrated MMIC subsystem assembly having its housing cover removed and showing side wall mounted radiating elements.
Figure 10:
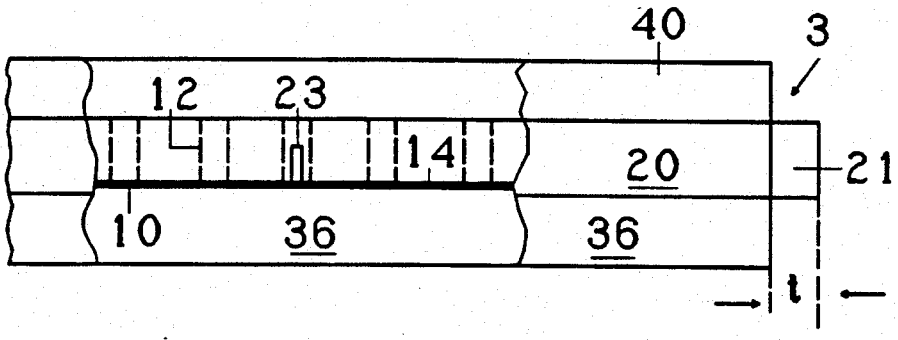
FIG. 10 is a cross-sectional side view of the invention according to FIG. 9.

Referring to FIG. 9, there is shown a top view of a portion of a MMIC subsystem assembly with the housing cover removed. The top surface 14 of the microstrip substrate shows a periodic array of circles 12 which designate the locations of the conductive posts in the waffle-wall configuration. As noted above, the tuned conductive posts 12 provide the electrical connection from the microstrip ground plane up to the top shield plane formed by the housing cover 40 as shown in FIG. 10 wherein the conductive posts 12 are illustrated by dashed lines. Located on the top surface 14 of the microstrip substrate 10 or in pockets formed in the substrate are a number of circuit components such as MMIC chips 24 formed on chip carriers 18. Microstrip transmission lines 16 run through the periodic array of conductive posts 12 and interconnect the various circuits components.

As shown in the top view of FIG. 9 and the side view of FIG. 10, a ceramic wall 20 is formed around the periphery of the microstrip substrate 10. The ceramic wall 20 is formed between the housing base 36, which can be made of Kovar and the housing cover 40 which may be of a metal or dielectric composition. Vertical launch probes 23 are located adjacent to the ceramic side wall 20 to radiate directed millimeter waves from the thin side wall edges of the assembly 3. The launch probes 23 radiate energy directed toward the side walls. The conductive posts 12 provide shielding from the radiation for the internal MMIC chips located on the microstrip substrate 10 and provide the backshorting for the waveguide mode launched from the vertical probes 23. The vertical probes 23 are coupled to the other active and passive circuit components via microstrip transmission lines 16. The two-dimensional periodic array of conductive posts 12 function as a band rejection filter structure which also provides the "walls" to guide the launched waves from the vertical probes 23 to the nearby ceramic dielectric side wall in the assembly 3. The vertical probes 23 can be tuned E-field type probes which are bonded to the ends of the microstrip transmission lines 16 perpendicular to the top surface 14 of the microstrip substrate 10. The probes 23 launch vertically polarized TE type waveguide mode between the microstrip ground plane and the parallel conducting surface of the housing cover 40. Impedance matching and/or filtering elements may be printed on the microstrip transmission lines 16 to improve the bandwidth of the launch probes 23.

As shown in FIG. 9, a vertical probe 23 is arranged on the broad side of the ceramic wall 20 as well as in a corner 25 of the ceramic wall. In this embodiment, the vertical probes 23 are located on the order of ¼ wavelength in front of a conductive post 12 functioning as a reflecting post to enhance the directivity of the launch probe 23. As indicated in FIG. 9 by the phantom circle 13, the conductive post between the reflecting post and the ceramic side wall is removed to form a direct path to the side wall that is above the cutoff frequency. Also shown for the broad side radiation element 23 is a "bulge" 21 which may be machined from the ceramic wall 20 to provide impedance matching to the outside environment. In this example, the bulge 21 has a thickness "T" on the order of ¼ wavelength to provide proper impedance matching.

Figure 11:
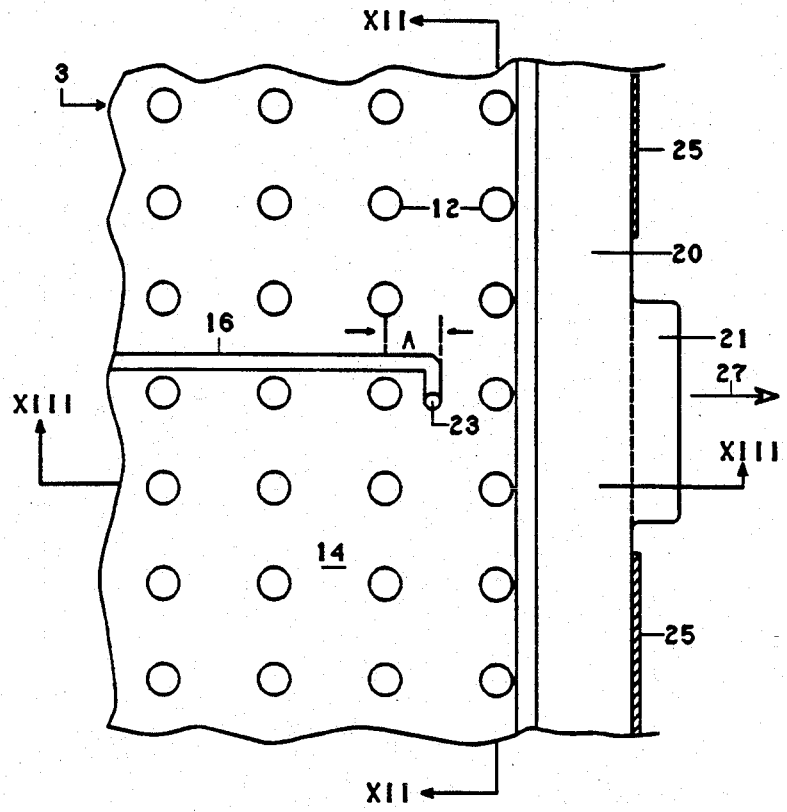
FIG. 11 is an enlarged top view of a side wall portion according to FIG. 9.

Referring to FIG. 11, there is shown a top view of a side wall portion of the integrated assembly subsystem 3 of FIG. 1 including a millimeter wave absorption film 25 applied on the outside of the assembly's ceramic wall 20. The millimeter wave absorption film serves to attenuate spurious waveguide propagation within the dielectric ceramic wall 20.

Figure 12:
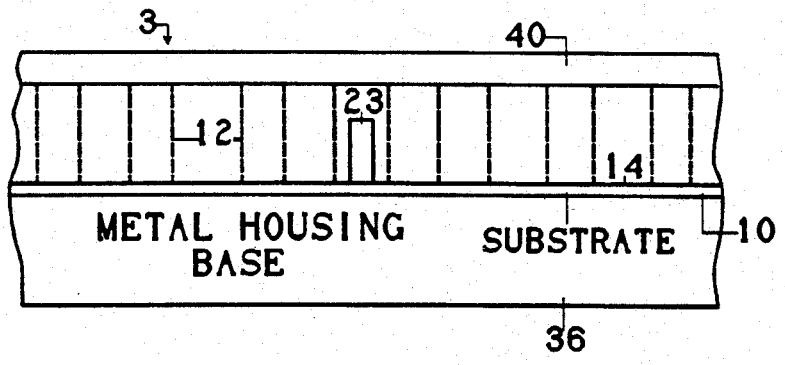
FIG. 12 is a cross-sectional side view taken along line XII—XII of FIG. 11.

FIG. 12 is a cross-sectional front view taken along line XII—XII of FIG. 11. The front view illustrates the stacked construction of the assembly 3 from the metal housing base 36 to the housing cover 40. As seen in FIG. 12, the launch probe 23 is a vertical probe which stands perpendicular to the microstrip substrate's top surface 14. As indicated by the dashed lines, the conductive posts 12 extend from the housing cover 40 and terminate near the top surface 14 of the microstrip substrate 10. The conductive posts 12 are tuned by the gap capacitance formed between the ends of the conductive posts 12 and the microstrip ground plane.

Figure 13:
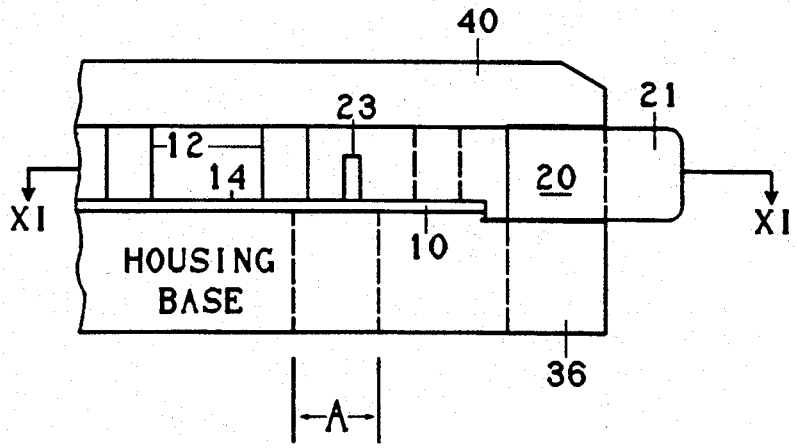
FIG. 13 is a cross-sectional side view taken along line XIII—XIII of FIG. 11.

In one example shown in the cross-sectional side view of FIG. 13, the ceramic wall 20 is on the order of one wavelength thick when operating at 60 GHz in the ceramic medium while the periodic array of conductive posts 12, having a 0.075 inch spacing between centers, is set to reject transmissions up to approximately 75 GHz. It is estimated for optimum performance that the launch probe 23-to-reflecting post 12 spacing "A" be on the order of half of the between-post spacing.

Figure 14:
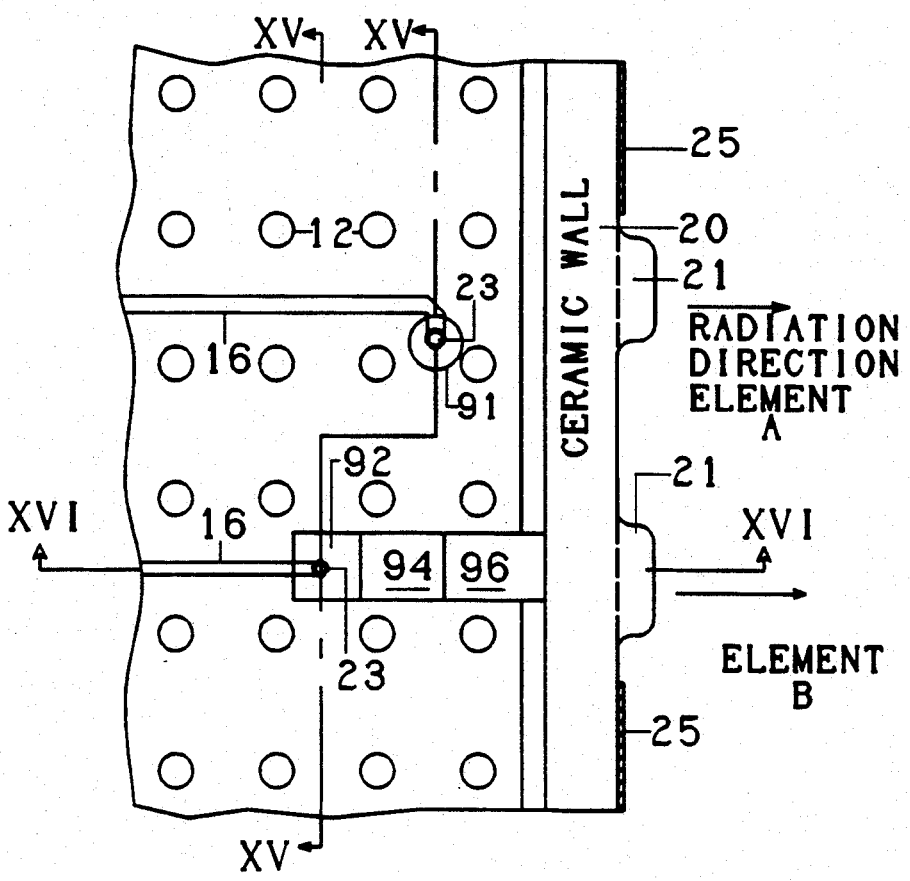
FIG. 14 is a top view of a portion of the subsystem assembly showing alternate embodiments for the side wall mounted radiating elements.

FIG. 14 is a top view showing alternate embodiments for the side wall mounted launch probes 23. For the radiation direction element A, the vertical launch probe 23 is provided with a dielectric sleeve support 91 which is bonded to the microstrip substrate top surface 14. In this example, the sleeve diameter and dielectric constant are designed to maximize the bandwidth while providing structural integrity for the launch probe 23. For radiation direction element B, a multi-sectioned dielectric guide transformer having stepped-up sections 92, 94 and 96 is provided to transition from the launch probe 23 to the ceramic dielectric wall 20. In this example, the dielectric loading allows the launched TE mode to propagate between the normally-spaced periodic array of conductive posts 12 to the ceramic wall 20. Propagation in the opposite direction away from the ceramic wall 20 is cut off beyond the dielectric piece 23 via the isolation performance of the conductive posts. Further, the dielectric stepped section 92, 94, 96 provides structural integrity for the launch probe 23.

Figure 16:
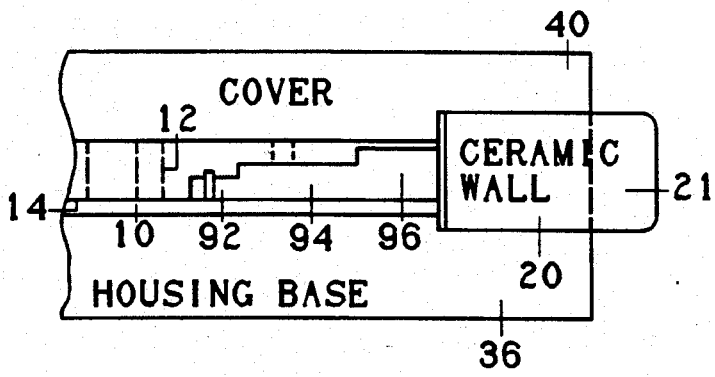
FIG. 16 is a partial cross-sectional view taken along line XVI—XVI of FIG. 14.
Figure 15:
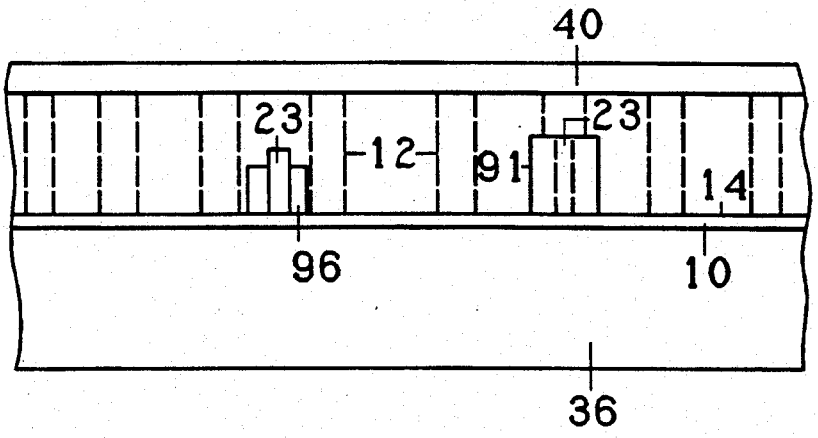
FIG. 15 is a cross-sectional view taken along line XV—XV of FIG. 14.

FIGS. 15 and 16 show a cross-sectional front view along line XV—XV and a cross-sectional side view along line XVI—XVI of FIG. 14, respectively.

Cover Radiating Elements

Figure 17:
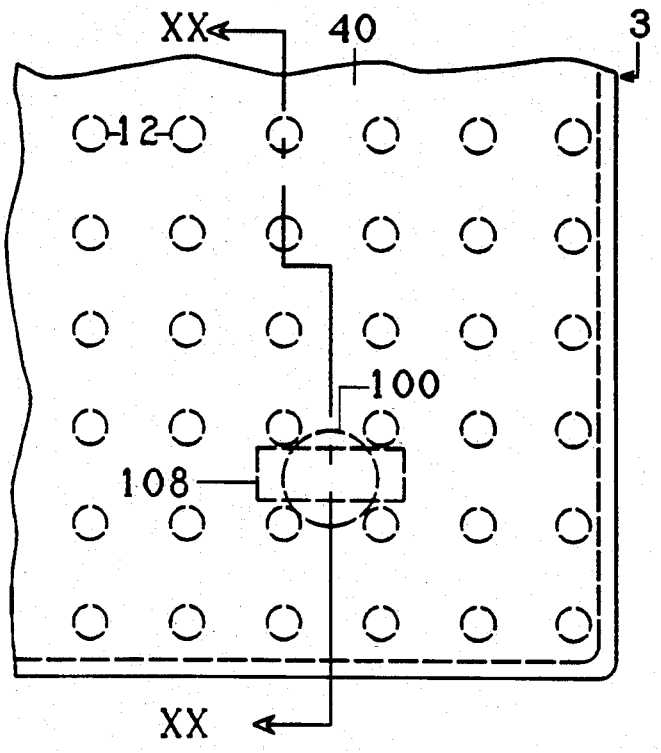
FIG. 17 is a top view of a portion of the integrated subsystem assembly showing a cover mounted radiating element.

In addition to providing launch probes near the side boundaries and housing base of the subsystem assembly, it is often desirable to provide radiating elements which radiate through the cover of the assembly. FIG. 17 is a top view of a subsystem assembly 3 having a housing cover 40. Illustrated in phantom below the cover 40 are the conductive posts 12 which provide the ground current connection. A rectangular slot 108 is also illustrated in phantom indicating where the metalization on the housing cover 40 was removed to allow radiation through the cover.

Figure 19:
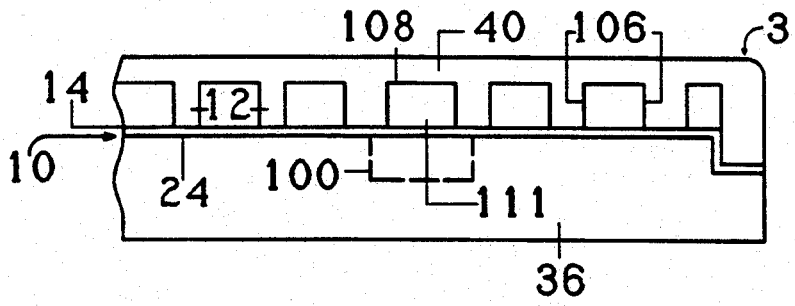
FIG. 19 is a cross-sectional view taken along line XIX—XIX of FIG. 18.
Figure 18:
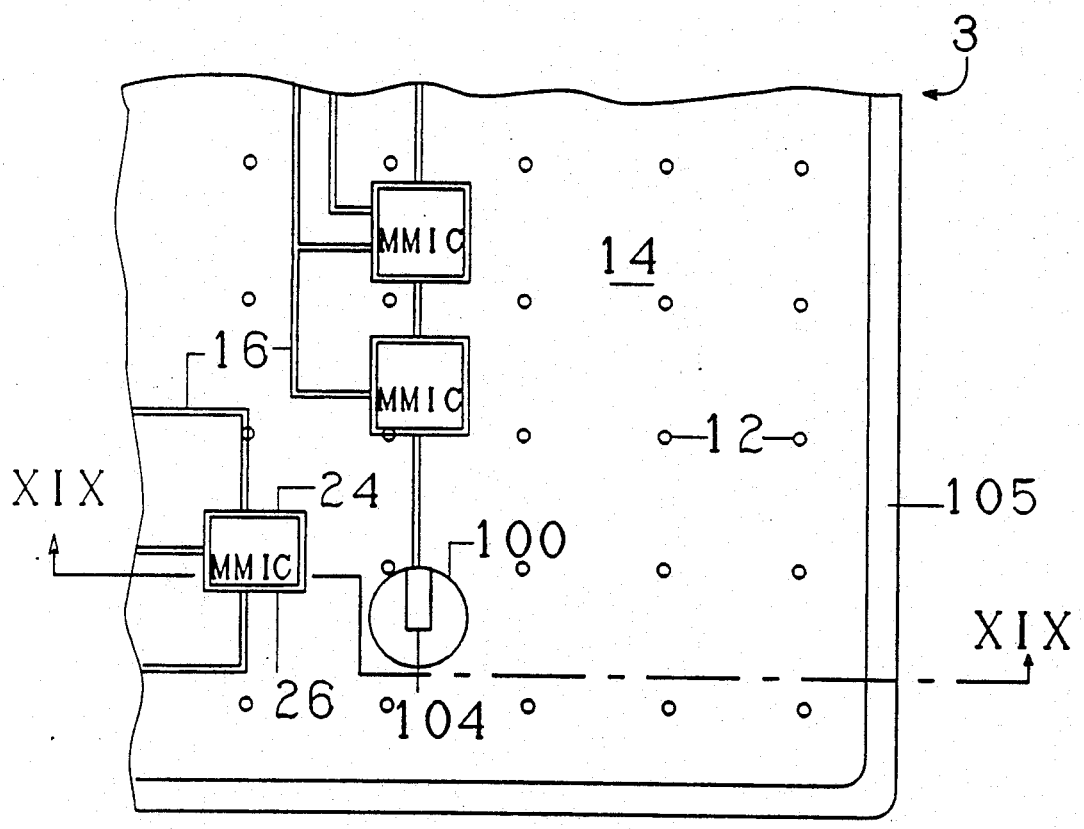
FIG. 18 is a top view of a portion of the subsystem assembly according to FIG. 17 having its cover removed.
Figure 20:
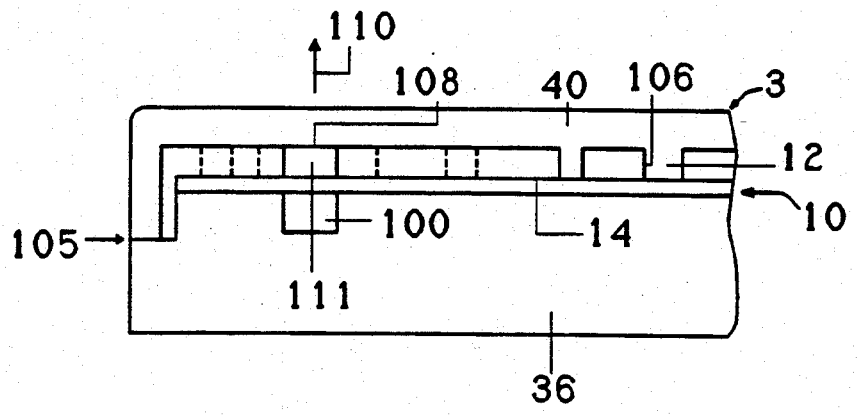
FIG. 20 is a cross-sectional view taken along line XX—XX of FIG. 17.

FIG. 18 is a top view of FIG. 17 with the housing cover 40 removed. The microstrip substrate has a top surface 14 on which circuit components such as MMIC chips 24 located on a carrier substrate 26 are placed or put in pockets in the substrates. These chips 24 are interconnected via microstrip transmission lines 16. A circular waveguide dielectric puck 100 is shown inserted into the microstrip substrate. A radiating element 104, such as a TE mode circular waveguide launch probe, is printed on the top surface. FIG. 19 is a cross-sectional side view through line XIX—XIX of FIG. 18 illustrating the insertion of a dielectric puck 100 into the housing base 36 and microstrip substrate 10. The radiating launch probe 104 is formed on the dielectric puck 100. FIGS. 19 and 20 show the dielectric apertures 108 provided in the housing cover 40. The cover 40 may be formed of a silicon dioxide material having an inside surface metal film 106 forming the conductive posts 12 and an interior top conductive shield. This top conductive shield is the output ground plane for the radiation element 104.

As shown in FIGS. 19 and 20, the metalization 106 is not provided in the aperture area 108 directly above the dielectric puck 100 and launch probe 104. By removing the metalization, the dielectric apertures 108 are provided in the otherwise conductive hermetic seal cover 40. A waveguide-like mode of propagation is then launched perpendicular to the top surface 14 of the microstrip substrate via the launch probe 104 and exits through the dielectric aperture 108 located directly above. The conductive posts 12 provide the necessary waveguide mode wall connection up to the top shield cover conducting surfaces 106. Further, the conductive posts 12 do not allow waveguide mode propagation parallel to the microstrip substrate 10 into or out of the radiation element launching area 111. As shown in FIG. 18, the connections from the MMIC chips 24 to the radiation elements 104 is via TEM mode microstrip transmission lines 16 which are run through the conductive post's 12 periodic grid structure. For increased bandwidth, the launch probes or resonators 104 may be cavity backed.

In the embodiment of FIGS. 17 through 20, a low TCE rate MMIC chip housing assembly, having an attached microstrip circuit substrate 10, includes a TCE matching dielectric cover 40 such as one formed of fused silica ($SiO_2$) or ceramic. The cover 40 can, for example, be brazed attached to the housing base 36 to provide a hermetic seal 105.

The circular dielectric puck 100 inserted into the deep cavity in the microstrip substrate 10 and housing base 36 can have a bandwidth which is approximately greater than 20%. A rectangular puck (not shown) could also be used to provide more than 50% bandwidth. For millimeter wave operation, the dielectric cover 40 can be ground to the required thickness for providing good impedance matching while maintaining a sufficient thickness for structural strength. For example, when operating at 60 GHz, a cover 40 having a thickness ranging from 0.03 to 0.06 inches provides proper structural strength and a good impedance match.

In an alternate embodiment, an additional dielectric puck (not shown) may be included between the microstrip radiation element 104 and the opening 108 in the metalized housing cover 40 to aid the coupling of the waveguide mode transmissions from the launch probe 104 in the radiation direction 110.

Figure 21:
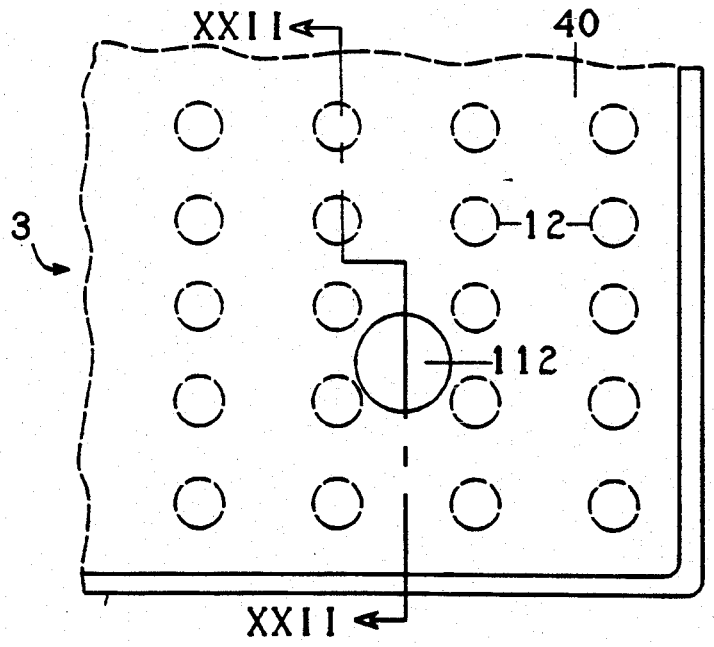
FIG. 21 is a top view of a portion of a subsystem assembly showing an embodiment according to the present invention.
Figure 22:
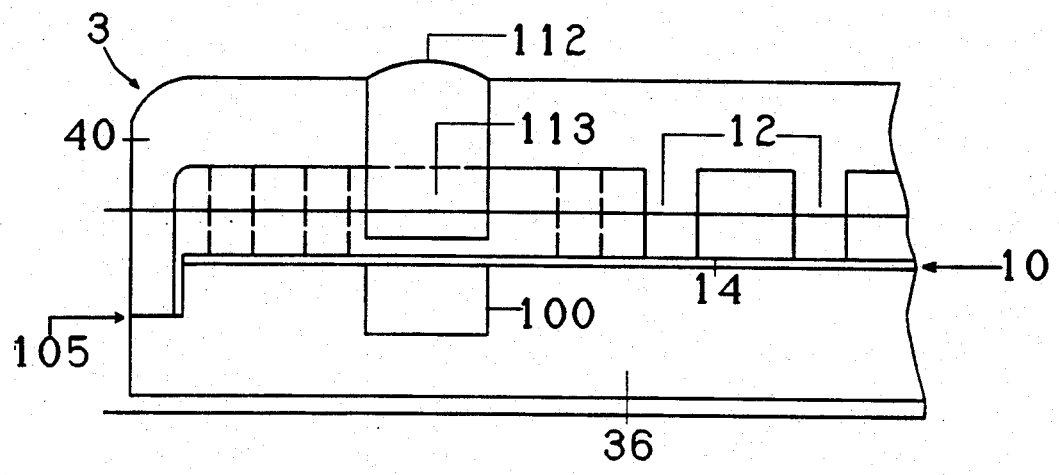
FIG. 22 is a cross-sectional view taken along line XXII—XXII of FIG. 21.

Another embodiment using a metal housing cover 40 made of a high TCE material such as aluminum alloy 6061T, is shown in FIGS. 21 and 22. FIG. 21 is a top view of the assembly 3 showing in phantom the conductive posts 12. The dielectric window through the metal housing cover 40 is shown as a circular dielectric waveguide section 112. FIG. 22 is a cross-section view along the line XXII—XXII of FIG. 21 showing the circular waveguide dielectric 112, which may also be rectangular, coupled to the radiating element (not shown) via the conductive posts 12. The dielectric waveguide section 112 located in the housing 40 can also include an additional length of dielectric 113 for impedance matching purposes. As shown in FIG. 22, the top surface of the dielectric 112 is curved. This shape or other shapings of the external end of the dielectric waveguide 112 and the nearby metal cover 40 can also be used for further impedance matching and beam width shaping. The cover element 112 can also, with minor modifications evident to those skilled in the art, be used for launching transmissions into a cover mounted waveguide for signal transmission to a remote site. The dielectric 112, 113 must be made of fused silica, alumina, or other type of moisture-tight material in order to maintain a hermetic assembly 3.

Figure 23:
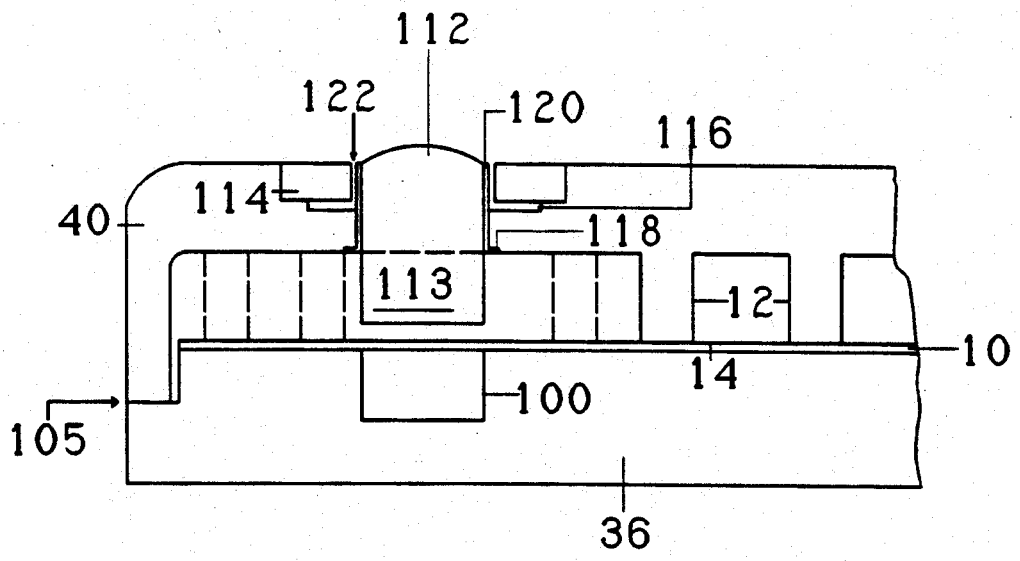
FIG. 23 is a cross-sectional view illustrating an alternate embodiment according to the present invention.

Referring to FIG. 23, there is shown a crosssectional side view of an alternate embodiment wherein the TCE of the housing cover 40 and that of the waveguide window 112 are not matched. In this embodiment, the dielectric waveguide 112 is sealed to a thin TCE matching metal alloy 118, such as Kovar, to form a tube which is soldered at one end to the inside of the housing cover 40. The soldered joint between the thin metal alloy 118 and the aluminum housing cover 40 may be designed to absorb the differential expansion without danger to the Kovar-to-dielectric seal. The opposite end 120 of the metal alloy sealed to the dielectric 112 is electrically connected to the top conductive surface of the housing cover 40 via a radial choke joint 122. This waveguide circuit causes a short circuit connection to appear at the end where the metal alloy tube ends. This allows a smooth current transition from the inside of the metal tube 120 to the top surface of the housing cover 40.

It should be noted that co-planer waveguide and other types of printed transmission lines can also be used in place of the microstrip lines used in the above examples. A typical separation distance between the top shield and substrate is approximately 0.25 inches. These schemes would also work directly with a very large size, wafer scale, active substrate, such as GaAs.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An assembly for waveguide launching microwave transmissions, comprising:

a housing base having a first opening formed through said housing base;

a substrate formed atop said housing base and having a second opening extending therethrough, said first and second openings substantially overlapping;

a housing cover enclosing said substrate and forming a cavity between said substrate and said housing cover, wherein said housing base and housing cover are hermetically sealed at their edges;

a launch substrate having top and bottom surface arranged in said second opening in the plane of said substrate and having dimensions less than those of said second opening to form an air gap between said launch substrate and said substrate;

a waveguide having side walls extending at one end through said first opening, said sidewalls being hermetically sealed at their one end to said launch substrate's bottom surface;

a first radiating element arranged on said top surface of said launch substrate for launching the microwave transmissions;

a periodic array of conductive posts arranged perpendicularly to the plane of said substrate and launch substrate; and a microstrip ground plane arranged perpendicularly to said conductive posts, wherein said conductive posts extend between said housing cover and substrate to provide an RF ground connection from said microstrip ground plane to said housing cover.

2. An assembly according to claim 1, further comprising:

a microstrip transmission line fabricated on said substrate;

a ribbon bond coupled at one end to said microstrip transmission line and at its other end to said first radiating element, said ribbon bond being formed across said air gap.

3. An assembly according to claim 2, further including at least one other radiating element arranged orthogonally to the first radiating element on said launch substrate.

4. An assembly according to claim 2, wherein said launch substrate is a dielectric launch substrate.

5. An assembly according to claim 4, wherein said dielectric launch substrate is formed from a ceramic composition.

6. An assembly according to claim 4, wherein said dielectric launch substrate is formed from a glass composition.

7. An assembly according to claim 1, wherein said hermetic seal between said launch substrate's bottom surface and the waveguide side walls is a solder seal.

8. An assembly according to claim 1, wherein said waveguide is circular.

9. An assembly according to claim 1, wherein said waveguide is rectangular.

10. An assembly according to claim 1, wherein said periodic array provides isolation and backshorting for said first radiating element.

11. An assembly for waveguide launching microwave transmissions, comprising:

a housing base including a first opening formed therethrough having inner side walls;

a substrate made of an organic material, having top and bottom surfaces, located atop said housing base;

a housing cover attached to said housing base and hermetically enclosing said substrate;

a first waveguide section, having a low thermal coefficient of expansion and an outer surface, inserted in said first opening in the housing base, said first waveguide section having one end spaced apart from said bottom surface of the substrate, said first waveguide section having a transformer section located at its other end away from said substrate;

a choke joint for coupling the first waveguide section to the housing base for absorbing differentials in thermal coefficients of expansion;

a radiating element aligned over said first waveguide section;

a two-dimensional array of conductive posts extending substantially perpendicularly to said top surface and said housing cover, a microstrip ground plane arranged perpendicular to said conductive posts, wherein said conductive posts provide an RF ground from said microstrip ground plane to said housing cover, a number of said conductive posts surrounding said radiating element; and wherein said choke joint comprises:

an eyelet having inner and outer surfaces and including a flange section, said inner surface of said eyelet compression sealed against the outer surface of said first waveguide section, said flange section being hermetically sealed to a lower end of said housing base; and a first space formed between said outer surface of said eyelet and said inner side walls of the opening in the housing base.

12. An assembly according to claim 11, further comprising:

a second waveguide section larger than said first waveguide section and hermetically sealed at one open end to said flange section; and wherein the transformer section of said first waveguide section extends into the open end of said second waveguide section for impedance matching between the first and second waveguide sections.

13. An assembly according to claim 12, wherein said first waveguide section is a quartz waveguide and said second waveguide section is an air dielectric waveguide.

14. An assembly for waveguide launching microwave transmissions, comprising:

a housing base including a first opening formed therethrough having inner side walls;

a substrate made of an organic material, having top and bottom surface, located atop said housing base;

a housing cover attached to said housing base and hermetically enclosing said substrate;

a first waveguide section, having a low thermal coefficient of expansion and an outer surface, inserted into said first opening in the housing base, said first waveguide section having one end spaced apart from said bottom surface of the substrate, said first waveguide section having a transformer section located at its other end away from said substrate;

a choke joint for coupling the first waveguide section to the housing base for absorbing differentials in thermal coefficients of expansion;

a radiating element aligned over said first waveguide section;

a two-dimensional array of conductive posts extending substantially perpendicularly to and between said top surface and said housing cover;

a microstrip ground plane arranged perpendicular to said conductive posts, wherein said conductive posts provide an RF ground from said microstrip ground plane to said housing cover, a number of said conductive posts surrounding said radiating element; and a second opening formed in said substrate substantially overlapping said first opening in said housing base wherein the radiating element is printed on the one end of the first waveguide section extending through said first opening; and a ribbon bond coupling said radiating element with the top surface of said substrate.

15. An assembly according to claim 14, wherein said choke joint comprises:

an eyelet having inner and outer surfaces and including a flange section, said inner surface of said eyelet compression sealed against the outer surface of said waveguide section, said flange section being hermetically sealed to a lower end of said housing base; and a first space formed between said outer surface of said eyelet and said inner side walls of the opening in the housing base.

16. An assembly according to claim 15, further comprising:

a second waveguide section larger than said first waveguide section and hermetically sealed at one open end to said flange section; and wherein the transformer section of said first waveguide section extends into the open end of said second waveguide section for impedance matching between the first and second waveguide sections.

17. An assembly according to claim 16, wherein said first waveguide section is a quartz waveguide and said second waveguide section is an air dielectric waveguide.

18. An assembly for waveguide launching microwave transmissions, comprising:

a housing base having a thermal coefficient of expansion;

an opening formed through said housing base having inner side walls;

a microstrip substrate, having top and bottom surfaces, located atop said housing base;

a housing cover attached to said housing base enclosing said microstrip substrate, said housing cover being hermetically sealed to the housing base;

a first waveguide section, having a thermal coefficient of expansion substantially similar to that of said housing base, said first waveguide section having one end extending into said opening in the housing base up to said bottom surface of the microstrip substrate and forming a transformer section at the other end away from said microstrip substrate;

a waveguide seal compression sealed on its inner surface to the outside of said first waveguide section and on its outer surface being soldered to said inner side walls of the housing base;

a radiating element located over said first waveguide section; and a periodic array of conductive posts extending substantially perpendicular to and between said top surface and said housing cover, a microstrip ground plane arranged perpendicular to said conductive posts, wherein said conductive posts provide an RF ground from said microstrip ground plane to said housing cover, a number of said conductive posts surrounding said radiating element; and a second waveguide section larger than said first waveguide section and hermetically sealed at one open end to said waveguide seal and housing base; and wherein the transformer section of said first waveguide section extends into the open end of said second waveguide section for impedance matching between the first and second waveguide sections.

19. An assembly according to claim 18, wherein said first waveguide section is a quartz waveguide and said second waveguide section is an air dielectric waveguide.

20. An assembly for waveguide launching microwave transmissions, comprising:

a housing base having a thermal coefficient of expansion;

an opening formed through said housing base having inner side walls;

a microstrip substrate, having top and bottom surfaces, located atop said housing base;

a housing cover attached to said housing base and enclosing said microstrip substrate, said housing cover being hermetically sealed to the housing base;

a first waveguide section, having a thermal coefficient of expansion substantially similar to that for said housing base, extending at one end into said opening in the housing base up to said bottom surface of the microstrip substrate and forming a transformer section at the other end;

wherein said first waveguide section is a ceramic waveguide having a metallized outer surface soldered directly to the inner side walls of said opening in the housing base;

a radiating element located over said first waveguide section; and a periodic array of conductive posts arranged to extend substantially perpendicular to and between said top surface and said housing cover, a number of said posts surrounding said radiating element.

21. An assembly according to claim 20, further comprising:

a second waveguide section larger than said first waveguide section and hermetically sealed at one open end to said metallized outer surface and housing base;

wherein the transformer section of said first waveguide section extends into the open end of said second waveguide section for impedance matching between the first and second waveguide sections.

22. An assembly according to claim 21, wherein said second waveguide section is an air dielectric waveguide.

23. A structure for radiating waveguide mode transmissions from a ceramic side wall having top and bottom surfaces in an assembly, comprising:

a housing cover sealed at its edges to the top surface of the ceramic side wall;

a housing base sealed at its edges to the bottom surface of the ceramic side wall;

a substrate located atop of said housing base;

a plurality of conductive posts forming a periodic array, said plurality of posts each being arranged substantially perpendicular to and between said housing cover and substrate;

a radiating element extending upward from said substrate and unobstructively located near the ceramic side wall in front of one of said conductive posts; and wherein a number of said conductive posts including said one conductive post reject waveguide mode transmissions not radiated toward the ceramic side wall.

24. A structure according to claim 23, wherein said ceramic side wall includes corners and wherein said radiating element is located near one of said corners of said ceramic side wall.

25. A structure according to claim 23, wherein the ceramic side wall includes a bulge portion extending outward from the assembly in the vicinity of said radiating element for impedance matching.

26. A structure according to claim 23, wherein said radiating element is spaced approximately ¼ wavelength in front of said one conductive post.

27. A structure according to claim 23, further comprising:

an absorption film covering portions of the ceramic side wall exterior of the assembly away from said radiating element for attenuating spurious waveguide mode transmissions within the ceramic side wall.

28. A structure according to claim 23 wherein said radiating element is surrounded by a dielectric sleeve support bonded to said substrate.

29. A structure according to claim 23, further comprising:

a multi-sectional dielectric guide transformer extending along said substrate from said radiating element to the ceramic side wall.

30. A method for radiating microwave transmissions from a ceramic side wall, having an interior and an exterior, of a hermetically sealed assembly including a housing base, housing cover, microstrip ground plane, and substrate, said substrate being located on top of said housing base between said housing base and housing cover, the method comprising the steps of:

providing a periodic two-dimensional matrix of conductive posts extending between the housing cover and substrate to provide an RF connection between the microstrip ground plane and said housing cover; and arranging a substantially vertical radiating element on the substrate, said radiating element being located between the ceramic side wall and one conductive post of said periodic two-dimensional matrix along a line perpendicular to the ceramic side wall running through the one conductive post, said one conductive post reflecting and directing microwave transmissions launched from the radiating element toward the ceramic side wall along said perpendicular line; and forming an impedance matching bulge along said perpendicular line on the exterior of said ceramic side wall.

31. A structure for radiating microwave transmissions, comprising:

a dielectric housing cover having an inner metallization layer;

an aperture formed in said inner metallization layer;

a housing base hermetically sealed to the housing cover and forming a ground plane;

a substrate located atop said housing base;

a plurality of conductive posts arranged in a two-dimensional matrix array forming a ground current coupling between said inner metallization layer and said ground plane;

a dielectric puck inserted into an opening in said substrate and housing base between a number of the plurality of conductive posts forming said matrix and underneath said aperture in said inner metallization layer; and a radiating element formed on said dielectric puck for launching microwave transmissions perpendicular to said substrate and through said aperture and dielectric housing cover.

32. A structure according to claim 31, wherein said aperture is formed by etching away a portion of said inner metallization layer.

33. A structure according to claim 32, further comprising a second dielectric puck arranged between said radiating element and said housing cover.

34. A structure for radiating microwave transmissions from an assembly, comprising:

a metal housing cover forming a top shield;

a housing base hermetically sealed to said housing cover forming a ground plane;

a substrate located atop said housing base;

a plurality of conductive posts arranged in a two dimensional matrix forming a ground current coupling between said top shield and said ground plane;

a dielectric puck inserted into an opening in said substrate and housing base between a number of said plurality of conductive posts forming said matrix of conductive posts;

an aperture formed in said housing cover over said dielectric puck;

a radiating element formed on said dielectric puck for launching microwave transmissions perpendicular to said substrate; and a dielectric window formed in said aperture for allowing transmission of said launched microwave transmissions through said housing cover.

35. A structure according to claim 34, wherein said metal housing cover has a thermal coefficient of expansion different from that of said dielectric window and further comprising:

a choke joint for coupling the dielectric window to said metal housing cover to absorb the differential thermal coefficients of expansion.

* * * * *